US005551252A

United States Patent [19]

Lee

[11] Patent Number: 5,551,252

[45] Date of Patent: Sep. 3, 1996

[54] REFRIGERATOR HAVING A COOL AIR CONDUCTING PASSAGE

[75] Inventor: Sun Gyou Lee, Kyungki-Do, Rep. of Korea

[73] Assignee: Samsung Electronics Co., Ltd., Kyungki-Do, Rep. of Korea

[21] Appl. No.: 366,104

[22] Filed: Dec. 29, 1994

[30] Foreign Application Priority Data

Jan. 26, 1994 [KR] Rep. of Korea ..... 94-1398

[51] Int. Cl.[6] ..... F25D 17/06

[52] U.S. Cl. ..... 62/441; 62/97; 62/414

[58] Field of Search ..... 62/97, 441, 404, 62/407, 408, 411, 413, 414, 89

[56] References Cited

U.S. PATENT DOCUMENTS

| | | | |
|---|---|---|---|
| 3,015,215 | 1/1962 | Tobey | 62/97 |
| 3,020,733 | 2/1962 | Hubacker et al. | 62/97 |
| 3,455,119 | 7/1969 | Bright | 62/441 |
| 3,590,594 | 7/1971 | Arend | 62/187 |
| 4,732,014 | 3/1988 | Frohbieter | 62/382 |
| 5,214,936 | 6/1993 | Lim et al. | 62/407 |
| 5,392,615 | 2/1995 | Lim | 62/414 |

FOREIGN PATENT DOCUMENTS

| | | | |
|---|---|---|---|
| 4187973 | 7/1992 | Japan | 62/97 |

*Primary Examiner*—Henry A. Bennett
*Assistant Examiner*—William C. Doerrler
*Attorney, Agent, or Firm*—Burns, Doane, Swecker & Mathis, L.L.P.

[57] ABSTRACT

A refrigerator includes a refrigerating compartment, a freezing compartment disposed beneath the refrigerating compartment, and a vegetable compartment disposed beneath the freezing compartment. Air discharged from the refrigerating compartment is conducted to the vegetable compartment. Air discharged from the freezing and vegetable compartments is conducted to the evaporator. Before reaching the evaporator, the air discharged from the freezing and vegetable compartments is combined to create a single air flow of uniform temperature entering the evaporator. The cool air discharged from the freezing compartment is discharged therefrom through separate outlets disposed at front and rear ends of the freezing compartment.

2 Claims, 6 Drawing Sheets

REFRIGERATOR HAVING A COOL AIR CONDUCTING PASSAGE

RELATED INVENTION

This invention is related to commonly assigned U.S. Ser. No. 08/365,957, filed concurrently herewith by the same inventor.

FIELD OF THE INVENTION

The present invention is related to a refrigerator having a cool air conducting passage, and more particularly, a refrigerator having a cool air conducting passage through which low temperature air is returned to the evaporator.

BACKGROUND OF THE INVENTION

A refrigerator is utilized to store various foodstuffs under either a frozen or a refrigerated condition for extending the freshness of the foodstuffs stored in the compartment. Such a refrigerator consists of one of two cooling types, one being a direct cooling type, that is, an evaporator in a refrigerating cycle is installed in a foodstuff storage chamber, and a direct heat-exchange is obtained. The other type of cooling is the indirect cooling type, that is, an evaporator is mounted in a passage, which is separated from the foodstuff chamber and the air which is heat-exchanged by the evaporator is directed to the foodstuff storage chamber by means of a fan.

The above refrigerator normally consists of freezing and refrigerating compartments, one being located above the other. Furthermore, the refrigerating compartment is provided with a separate chamber, having a different temperature from that of the refrigerating compartment, known as a "vegetable compartment" or a "chilled compartment" which stores meats etc. The foodstuffs can be separately stored in the chamber in accordance with the desired conditions. On the front surface of each of the freezing and refrigerating compartments a door is installed. The doors hinge on vertical side in order to provide access to the foodstuffs in their respective compartment. For the passage of cool air, a condenser and a fan are installed in the rear wall of the freezing compartment.

Recently, since the refrigerating compartment is more frequently used than the freezing compartment, when the foodstuffs are stored in or taken from the refrigerating compartment, in order that the user can use the refrigerator more conveniently, the refrigerating compartment is arranged at the upper portion of the refrigerator whilst the freezing compartment is arranged at the lower portion of the refrigerator. The conventional refrigerator is shown in FIG. 6, that is, a refrigerating compartment 6 is in the upper portion of the refrigerator and beneath the refrigerating compartment 6 there is provided a freezing compartment 5, and between the refrigerating compartment 6 and the freezing compartment 5 there is provided an intermediate partition wall 4.

In the intermediate partition wall 4 there is provided an evaporator 7 for cooling the air circulated from the interior of each compartment and. At the rear portion of the evaporator 7 is installed a fan 8 for circulating cool air the fan facing toward the inner rear wall of the refrigerator. Part of the cool air passing the evaporator 7 is circulated to the inside of the freezing compartment 5 by the fan 8. The other part of the cool air is conducted upwardly through a main duct 3 disposed in the upper part of rear wall of the refrigerator. That air enters the refrigerating compartment 6 through a plurality of openings 13 which are formed in an inner wall of the duct 3 so that foodstuffs in the refrigerating compartment 6 are stored in accordance with the temperature range corresponding to the individual characteristic of the specific foodstuffs.

Further, at the entrance of the main duct 3 there is mounted a damper 11 for controlling the air volume directed to the refrigerating compartment 6 by the fan 8. A vegetable container 9 is placed in the lower portion of the refrigerating compartment 6 to contact cool air circulating through refrigerating compartment 6 for keeping the foodstuffs in the proper condition. In the front portion of the intermediate partition wall 4 there are formed upper and lower openings 14,15 for conducting to the evaporator 7 the cool air from the refrigerating compartment 6 to the freezing compartment 5, respectively. Further, in the intermediate partition wall 4 there is formed an air conducting passage (not shown) for guiding the cool air flows entering in the intermediate partition wall 4 through openings 14,15.

The air conducting passage is formed in order that the cool air entering through the opening 14 from the refrigerating compartment 6 is induced to flow to a horizontal end of a front side of the evaporator 7. Thus, a first exit of the incoming portion of the air conducting passage is disposed closely adjacent to an end of the front side of the evaporator 7. Simultaneously, the air conducting passage is formed in order that the cool air entering through the opening 15 from the freezing compartment 5 is induced to flow to a horizontal central portion of the front side of the evaporator 7. Thus, a second exit of the incoming portion of the air conducting passage is disposed closely adjacent to the front side of the evaporator 7.

Thus, the cool air from the freezing compartment 5 and from the refrigerating compartment 6 are guided separately through the air conducting passage until reaching the evaporator 7. As a result the evaporator is easily covered over with frost in that the air from the refrigerating compartment 6 has a moisture of high density. Further, since the cool air from the freezing compartment 5 and from the refrigerating compartment 6 are is passed through separate lanes of the evaporator 7, the heat-exchanging efficiency of the evaporator is decreased.

SUMMARY OF THE INVENTION

The present invention provides a refrigerator having a cool air conducting passage which can easily and effectively remedy the above mentioned problems.

The object of the present invention is to provide a refrigerator having a cool air conducting passage that can combine the cool air from a refrigerating compartment and the cool air from a freezing compartment, the combined cool air then supplied to an evaporator, thereby preventing the evaporator from icing over and increasing the efficiency of the heat-exchanging.

According to the present invention, the refrigerator comprises a refrigerating compartment, a freezing compartment, an evaporator located in the rear wall of the freezing compartment, a vegetable compartment, and a combining portion in which the first cool air flowed through a first opening from the freezing compartment and the second cool air flowed through a second opening from the refrigerating compartment are combined.

Further, the first opening, the second opening, and the combining portion are provided at an intermediate partition wall between the freezing compartment and the vegetable compartment.

Furthermore, the first opening and the second opening are provided at front ends of the upper and lower surfaces, respectively, of the intermediate partition wall, and a third opening is provided at the rear of the upper surface.

As cool air flows through it becomes warmer and enters the intermediate partition wall through the second opening. Simultaneously, cool air from the freezing compartment enters the intermediate partition wall through the first opening. The air entering the intermediate partition wall through the first and second openings is combined so that the relatively warm air from the vegetable compartment is is cooled. The combined air is further combined with other cool air from the freezing compartment which enters the intermediate partition wall through the third opening. Then the yet cooler air is directed to the evaporator.

DETAILED DESCRIPTION OF THE PREFERRED EMBODIMENT

Figure 1:
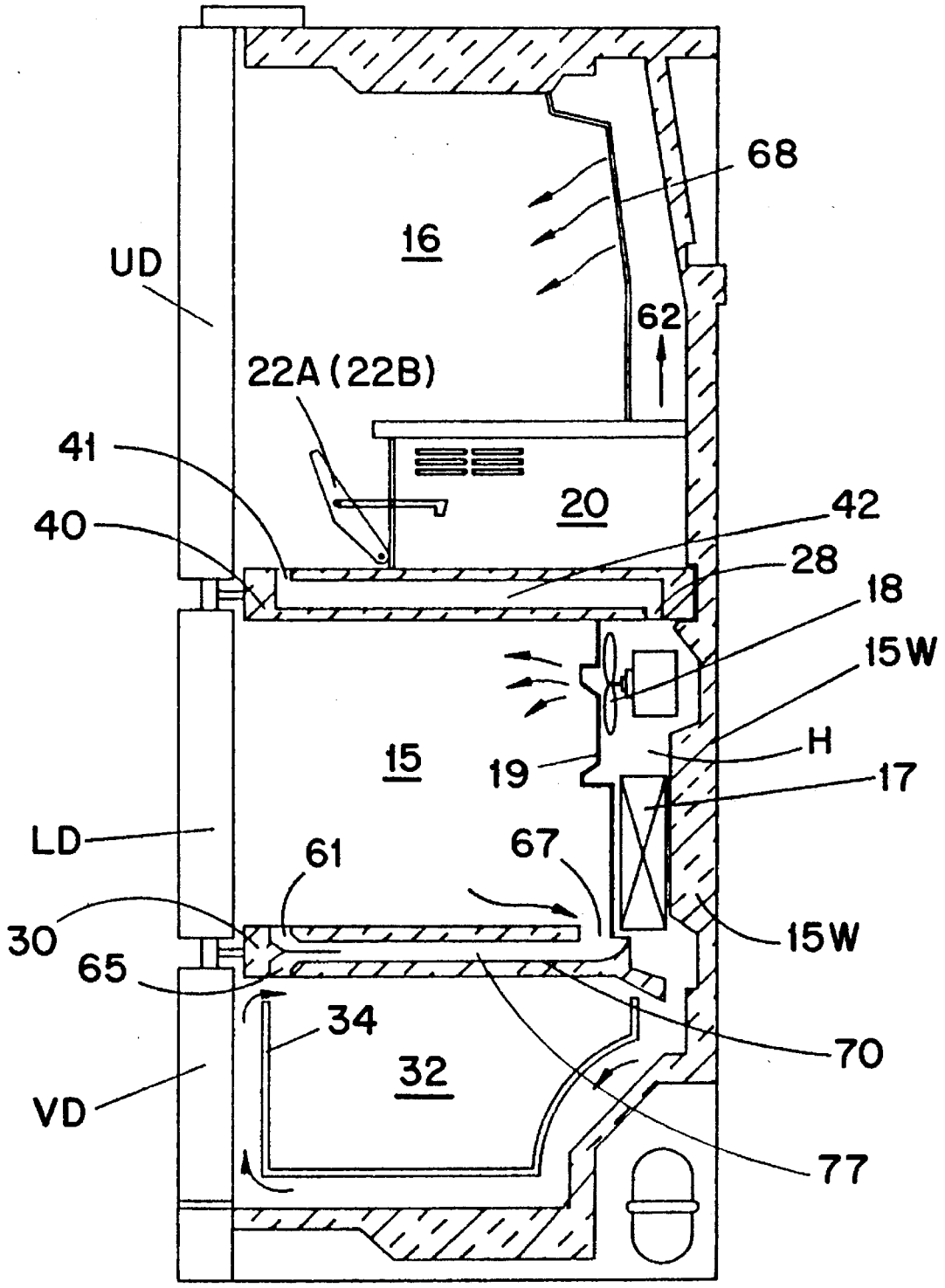
FIG. 1 is a cross-sectional view through a refrigerator according to the present invention, the section defined by a plane disposed perpendicular to front and rear walls of the refrigerator.
Figure 2:
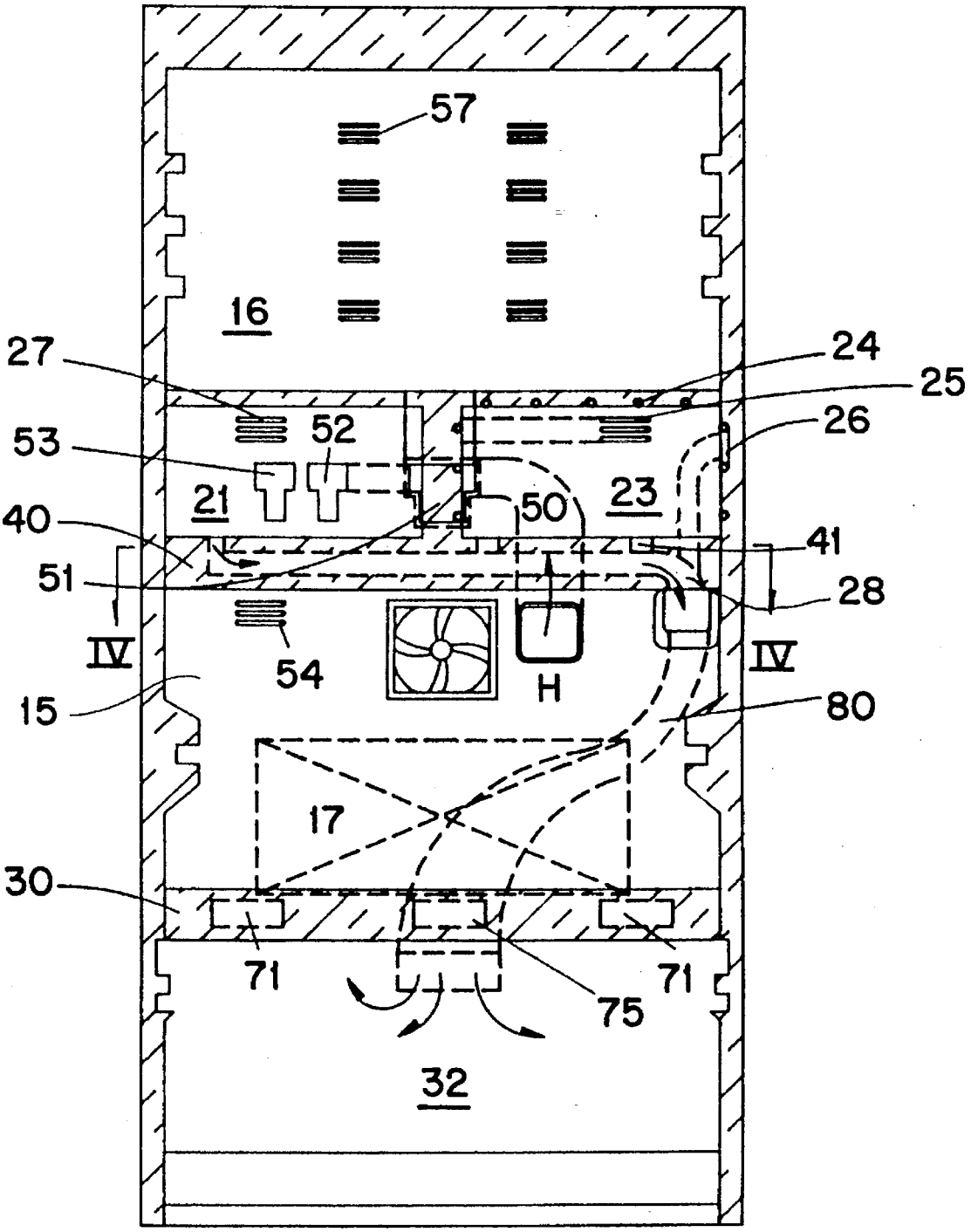
FIG. 2 is a sectional view through the refrigerator of FIG. 1, the section defined by a plane disposed parallel to the front and real walls.

In FIGS. 1 and 2, the refrigerator includes a refrigerating compartment 16, an individual compartment 20, a freezing compartment 15, and a vegetable compartment 32 which are vertically superimposed one upon the other. The refrigerating compartment 16, and the freezing compartment 15 are equipped with doors UD,LD on the front side of the compartments 16,15, respectively. Each door UD,LD is hinged on a vertical axis on a side of each compartment. The individual compartment 20 has doors 22A,22B which are hinged on horizontal axes on the lower horizontal corners of the doors 22A,22B. The vegetable compartment 32 has a door VD, at the front of the vegetable compartment 32, which is integrally formed with the vegetable box 34 for sliding the box forward or backward.

Further, a first partition wall 40 is formed between the refrigerating compartment 16 and the freezing compartment 15, and a second partition wall 30 is formed between the freezing Compartment 15 and the vegetable containing compartment 32.

The individual compartment 20 is covered over by an insulation material that separates the individual compartment 20 from the refrigerating compartment 16. The individual compartment 20 comprises a chilled chamber 21 for allowing the foodstuffs to be stored within a temperature range relative to the individual characteristics of the specific foodstuffs, and a kimchi chamber 23 for fermenting kimchi at a high temperature and the fermented kimchi at a low temperature.

At the rear wall 15W of the freezing compartment 15 there is provided a heat-exchanging compartment H which has an evaporator 17 and fan 18. A vertical wall 19 of the compartment H is provided in front of and spaced from the evaporator 17 and the fan 18, and a plurality of discharging openings 54 are formed on the vertical wall 19.

Figure 3:
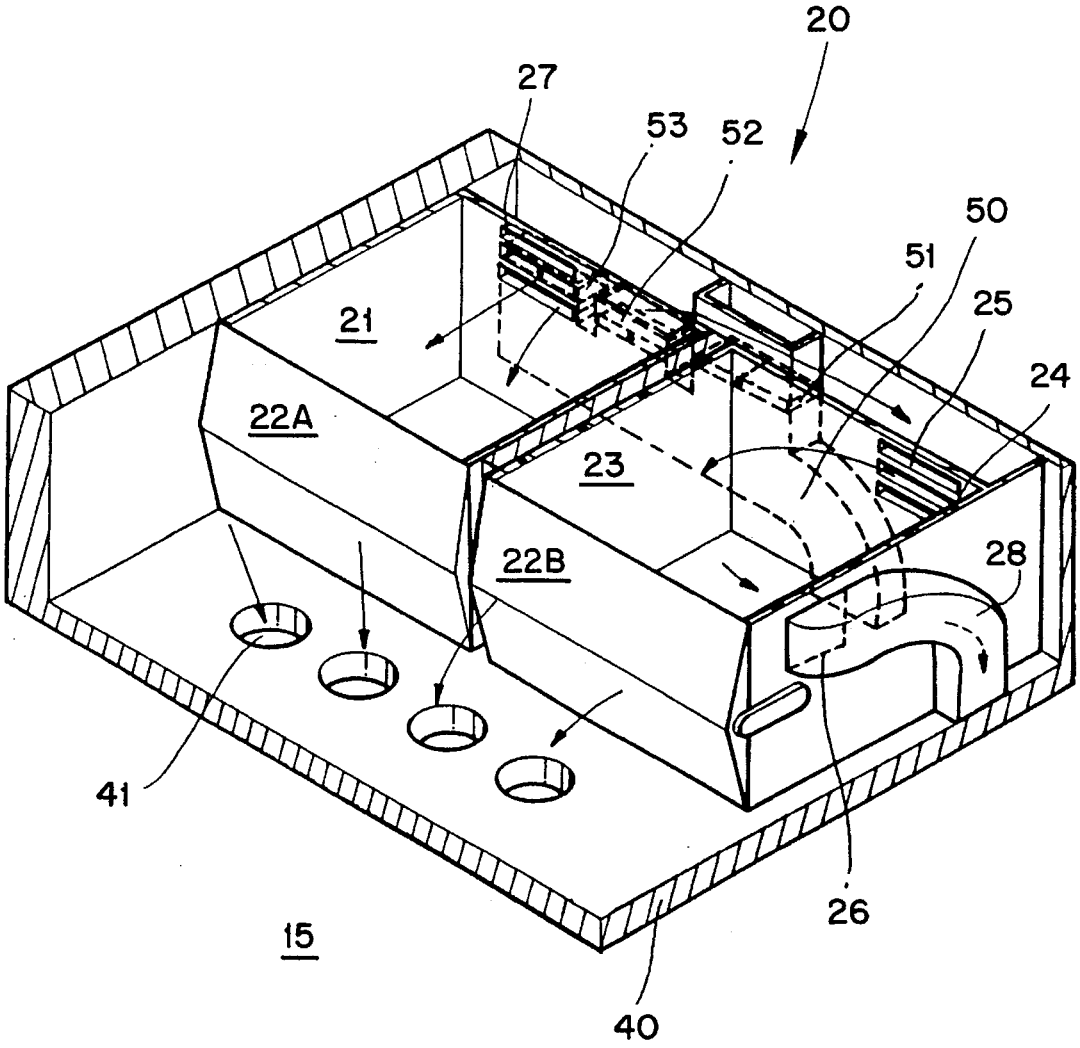
FIG. 3 is a perspective view of an individual compartment having a cool air conducting passage.
Figure 4:
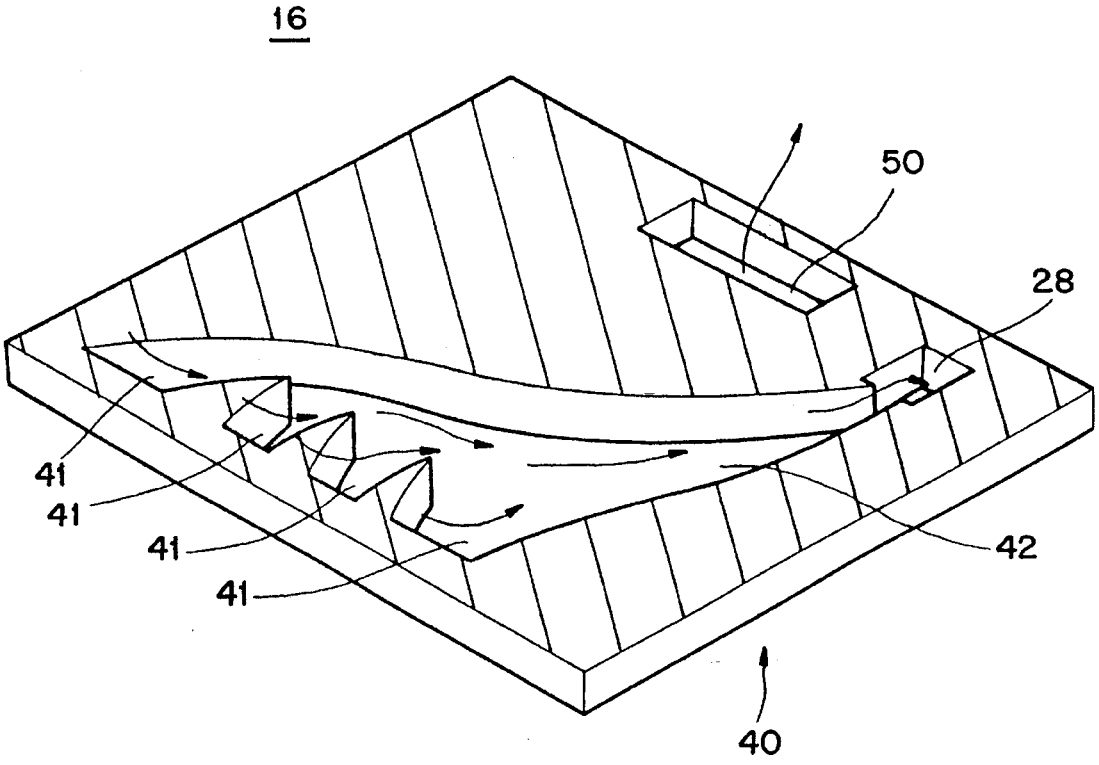
FIG. 4 is a perspective sectional view of a first intermediate partition wall taken along line IV—IV in FIG. 2.

A main duct 50 extends vertically through the first intermediate partition wall 40 as shown in FIG. 4. Through this duct cool air is induced by the fan 18 into the freezing compartment 15 and every other compartment, that is, the refrigerating compartment 16 and the individual compartment 20 (FIG. 3). In the upper portion of the main duct 50, spaced from the lower inlet opening of the main duct 50, a main damper 51 is mounted (see FIG. 2) for controlling the flow of cool air from the heat-exchanging compartment H into the refrigerating compartment 16 and thus for controlling the air volume to the refrigerating compartment 16. Individual dampers 52,53 control the flow of cool air from the heat-exchanging compartment H into respective chambers 21,23, and thus, control the air volume to each chamber 21,23.

On the other hand, a description of the structure of a cool air conducting passage 42 of the first intermediate partition wall 40 and a cool air passage 28 of the kimchi chamber 23 (FIGS. 3 and 4) will be omitted because the structure thereof is described in detail in Korean Utility Model Application No. 94-1465 (1994).

Figure 5:
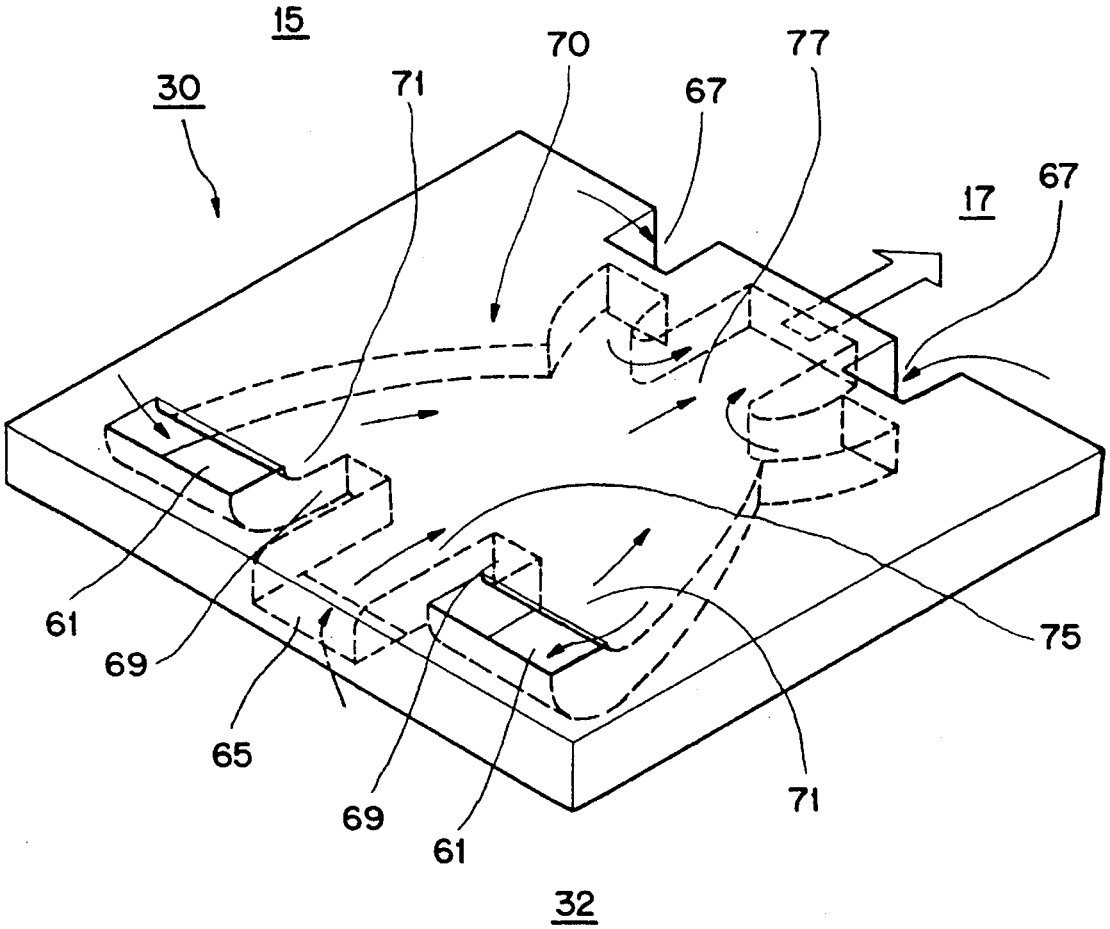
FIG. 5 is a perspective view of a second intermediate partition wall having a cool air conducting passage of the present invention.
Figure 6:
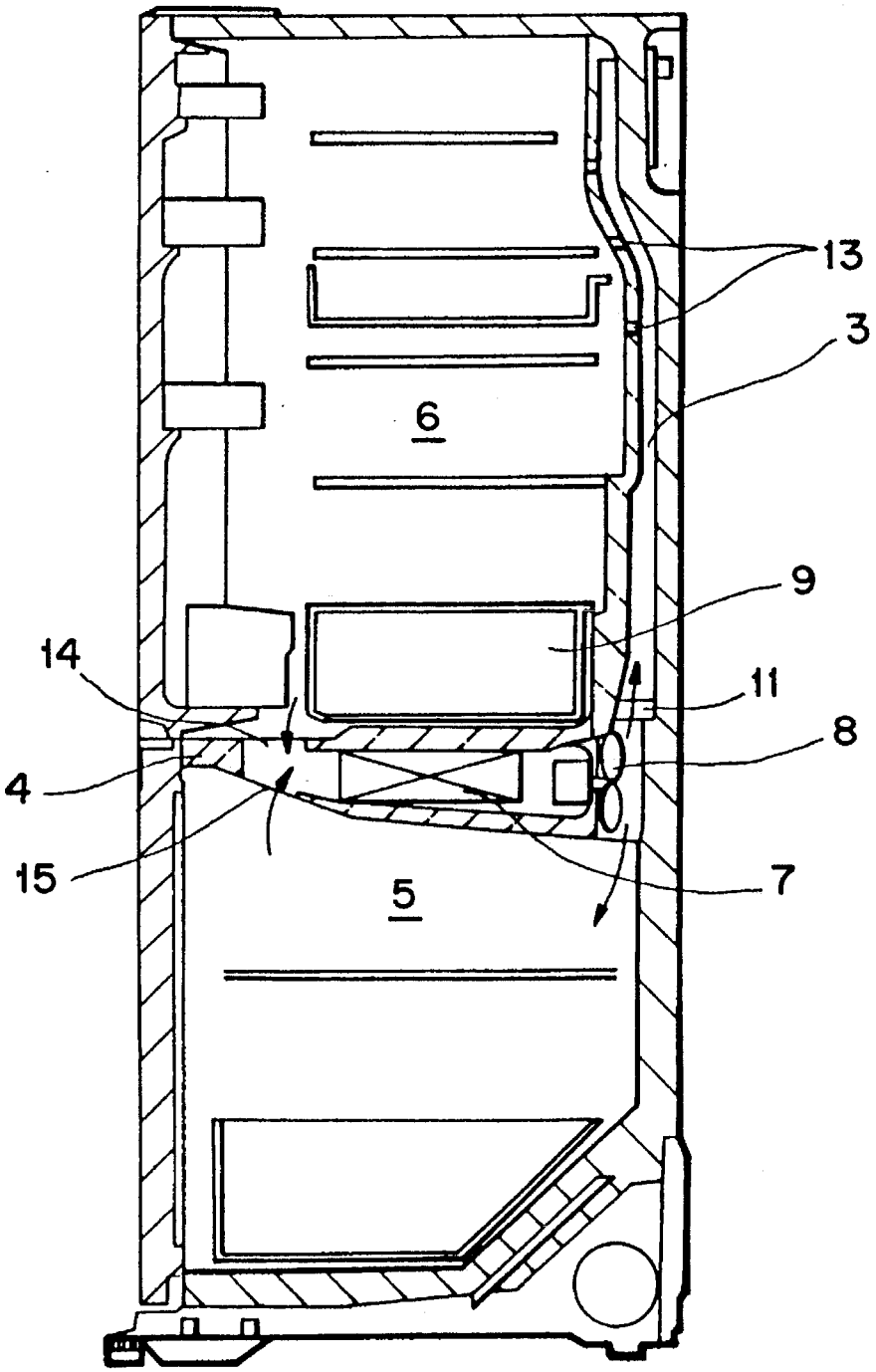
FIG. 6 (PRIOR ART)
FIG. 6 is a side vertical cross-sectional view similar to FIG. 1 of a conventional refrigerator.

In the second intermediate partition wall 30, a cool air passage 70 is formed for guiding the relatively cool air from the freezing compartment 15 and the relatively warm air from the vegetable compartment 32 into the evaporator 17. The cool air passage 70 is shown in FIG. 5.

In the front of the top side of the second intermediate partition wall 30 there are provided upper openings 61 for admitting cool air from the freezing compartment 15 into the cool air passage 70. Further, located centrally in the front of the bottom side of the second intermediate partition wall 30 there is provided a lower opening 65 for admitting relatively warm air from the vegetable compartment 32 into the cool air passage 70.

The cool air passage 70 comprises first guide ducts 71,71 formed at respective sides of the second intermediate partition wall 30, and a second guide duct 75 formed in the center of the second intermediate partition wall 30. Further, intermediate walls 69, 69 are formed between the first guide ducts 71 and the second guide duct 75, and are extended toward the rear of the second intermediate partition wall 30 by a predetermined length. Furthermore, auxiliary openings 67,67 are formed in the rear of the top side of the second intermediate partition wall 30. The length of each intermediate wall 69 is selected so that the cool air entering through each guide duct 71,75 can not be combined with each other. In this embodiment, each intermediate wall 69 extends rearwardly to about one-third of the distance from the front to the rear of the second intermediate partition wall 30. Rearwardly of the intermediate wall 69 there is provided a combining area 77 where the cool air through the guide ducts 71,75 is combined. Moreover, additional cool air from the freezing compartment 15 flows into the combining area 77 through the auxiliary openings 67,67.

The operation of the refrigerator will now be explained with reference to the attached drawings.

Some of the cool air heat-exchanged in the evaporator 17 is moved by the fan 18 to the freezing compartment 15 through the discharging opening 54 formed in the rear wall 19. At the same time, the remaining cool air heat-exchanged by the evaporator 17 is moved to the main duct 50 by the fan 18. The cool air in the main duct 50 is directed to the main damper 51, and to the individual dampers 52,53 for the chilled chamber 21 and the kimchi compartment 23, dependent on the temperature condition of these compartments. The cool air that has passed the main damper 51 is discharged into the refrigerating compartment 16 through the discharging opening 57 formed in the rear wall 68 of the refrigerating compartment 16o The cool air circulated in the refrigerating compartment 16 then flows through the cool air conducting passage 42 via the air return opening 41 of the first intermediate partition 40. The cool air exiting the conducting passage 42 is directed to the cool air passage 28 as shown in FIG. 1.

The cool air that passes the damper 52 for the kimchi compartment 23 circulates in the kimchi compartment 23, and then is introduced into the kimchi compartment air discharging opening 26 formed on the right wall of the kimchi compartment 23 (FIG. 3). The cool air passing through opening 26 flows into a duct 80 via a portion of the cool air passage 28 formed on the right wall of the kimchi compartment 23 as shown in FIG. 3. The air flows circulated from the kimchi compartment 23 and the refrigerating compartment 16 are combined in the common passage 28 to become of uniform temperature and is directed to the vegetable compartment 32 via the duct 80.

The relatively warm air circulated in the vegetable compartment 32 moves to the second guide duct 75 through the lower opening 65 of the second partition wall 30 as shown in FIG. 5. Simultaneously, the relatively cooler air circulated in the freezing compartment 15 moves to the first guide ducts 71 through the upper openings 61. The air passed along the first guide ducts 71 and the second inducing duct 75 is combined in the combining area 77, thereby decreasing the temperature of the air entering through the second inducing duct 75. Further, that combined air combines with the cool air entering through the rear upper openings 67. The air is then further cooled and is conducted to the evaporator 17.

Due to the presence of the rear upper openings 67 of the second partition wall 30, the temperature distribution of the lower portion of the freezing compartment 15 can be made more uniform. If only the front upper openings 61 were formed in the second partition wall 30, most of the air circulated in the freezing compartment 15 would travel to the front upper openings 61 and no active circulation would be achieved at the lower rear portion of the freezing compartment 15.

As the air passes through the second partition wall 30 of the refrigerator, before reaching the evaporator, the warmer air from the vegetable compartment is fully thus-combined with the air from the freezing compartment and the combined air is directed to the evaporator. That prevents the evaporator from being frosted over, and increases the heat-exchanging efficiency of the evaporator.

What is claimed:

1. A refrigerator, comprising:

a refrigerating compartment having an air inlet and an air outlet;

a freezing compartment spaced vertically from said refrigerating compartment and having an air inlet and first and second air outlets disposed at front and rear regions, respectively, of a lower portion of said freezing compartment;

a vegetable compartment disposed beneath said freezing compartment and including an air inlet connected to said air outlet of said refrigerating compartment;

a common wall separating said freezing and vegetable compartments and forming a first passage structure having first and second air inlets communicating with said first and second air outlets, respectively, of said freezing compartment, and a third air inlet communicating with an upper portion of said vegetable compartment, said first passage structure conducting combined air received from said first, second, and third air inlets thereof;

an evaporator arranged to receive all of the combined air conducted by said first passage structure; and a second passage structure connecting an outlet of said evaporator with said air inlets of both of said refrigerating and freezing compartments, whereby a portion of air cooled in said evaporator is delivered to said refrigerating compartment, and the rest is delivered to said freezing compartment.

2. The refrigerator according to claim 1, wherein said freezing compartment is disposed beneath said refrigerating compartment.

* * * * *